US006691377B2

(12) United States Patent
Pan

(10) Patent No.: US 6,691,377 B2
(45) Date of Patent: Feb. 17, 2004

(54) BUCKLE STRUCTURE OF SWIMMING MASK

(75) Inventor: Chen-Lieh Pan, Ilan Hsing (TW)

(73) Assignee: QDS Injection Molding LLC, San Diego, CA (US)

( * ) Notice: Subject to any disclaimer, the term of this patent is extended or adjusted under 35 U.S.C. 154(b) by 0 days.

(21) Appl. No.: 10/265,150

(22) Filed: Oct. 7, 2002

(65) Prior Publication Data

US 2003/0233737 A1 Dec. 25, 2003

(30) Foreign Application Priority Data

Jun. 21, 2002 (TW) ..... 91209334 U

(51) Int. Cl.[7] ..... A44B 11/06
(52) U.S. Cl. ..... 24/170; 2/452
(58) Field of Search ..... 24/170, 168, 191, 24/193, 197, 307; 351/43, 156; 2/452, 426

(56) References Cited

U.S. PATENT DOCUMENTS

| | | | | |
|---|---|---|---|---|
| 4,607,398 A | * | 8/1986 | Faulconer | 2/452 |
| 6,105,177 A | * | 8/2000 | Paulson et al. | 2/431 |
| 6,276,794 B1 | * | 8/2001 | Chiang | 351/43 |
| 6,349,420 B1 | * | 2/2002 | Chiang | 2/428 |
| 6,350,030 B2 | * | 2/2002 | Fujima | 351/43 |

* cited by examiner

*Primary Examiner*—Robert J. Sandy
(74) *Attorney, Agent, or Firm*—Troxell Law Office PLLC

(57) ABSTRACT

A new buckle structure on the two sides of a diving mask, these buckles are used to connect to the strap; the structure includes a frame on each side of the mask frame, a setting hole on the frame, a holder fixed and a fixed cover of the setting hole, a button on fixed cover, the strap goes between holder and a roller, the stopper on the button allows the users to adjust the strap; the structures allows the users to lose the strap by pressing down the button, also the strap can rotate within a small angle due to the holder structures.

2 Claims, 3 Drawing Sheets

BUCKLE STRUCTURE OF SWIMMING MASK

FIELD OF THE INVENTION

This invention relates generally to buckle structure of swimming mask. More particularly, this invention relates to a push buckle for more efficient function and simple to assemble.

BACKGROUND OF THE INVENTION

Diving masks generally have a buckle on each side of the frame in order to adjust the length of the strap that secures the mask to the diver's head. These buckles come in one of three types:

1. Simple buckles that require removing the mask (in order to re-weave the strap) for re-adjustment. The advantage is that the design is simple and low cost. The disadvantage is that strap adjustment is difficult and cumbersome.
2. Pull buckles that allow an automatic tightening of the strap by pulling on the strap (the buckle has a one-way feature), and a pulling motion in order to release (loosen) the strap. Many of these buckles have a swivel action that allows the strap to move into a position over the diver's ears that is comfortable and secure.
3. Push buckles that allow an automatic tightening of the strap by pulling on the strap (the buckle has a one-way feature), and a pushing motion in order to release (loosen) the strap.

The main purpose of a swivel mask buckle is to allow the strap to move at an angle such that the mask is securely positioned. Secondarily, another purpose of the swivel is to allow the strap to be positioned above the user's ear, which is more comfortable.

Simple buckles are relatively inexpensive to make, but lack the swivel and automatic tightening features. Pull buckles often have the swivel and automatic tightening features but are relatively difficult to use, especially if the user is a SCUBA diver wearing thick gloves. Push buckles usually have the automatic tightening feature and are relatively easy to use but lack the swivel feature.

The ideal buckle would have push button activation for release, automatic tightening (when the strap is pulled), and a swivel action, and be relatively easy to manufacture and assemble.

While scuba diving, the diver usually wears thicker gloves; therefore, it is harder to adjust the tightness and position of the mask that uses simple buckles or pull buckles.

Push buckles in these cases may be the best choice, also these buckles can do a certain angle of rotation, so the user with thick gloves can adjust the mask easily. On the other hand, these buckles are also easy to produce.

SUMMARY OF THE INVENTION

One object of the present invention is to provide a type of push buckle that contains a structure that can losen the strap by pushing the buckle, and also to make a small angle of rotation.

The second goal of providing this buckle is the produce lesser and simpler components, which are easier to assemble.

DESCRIPTION OF THE PERFERRED EMBODIMENTS

Figure 1:
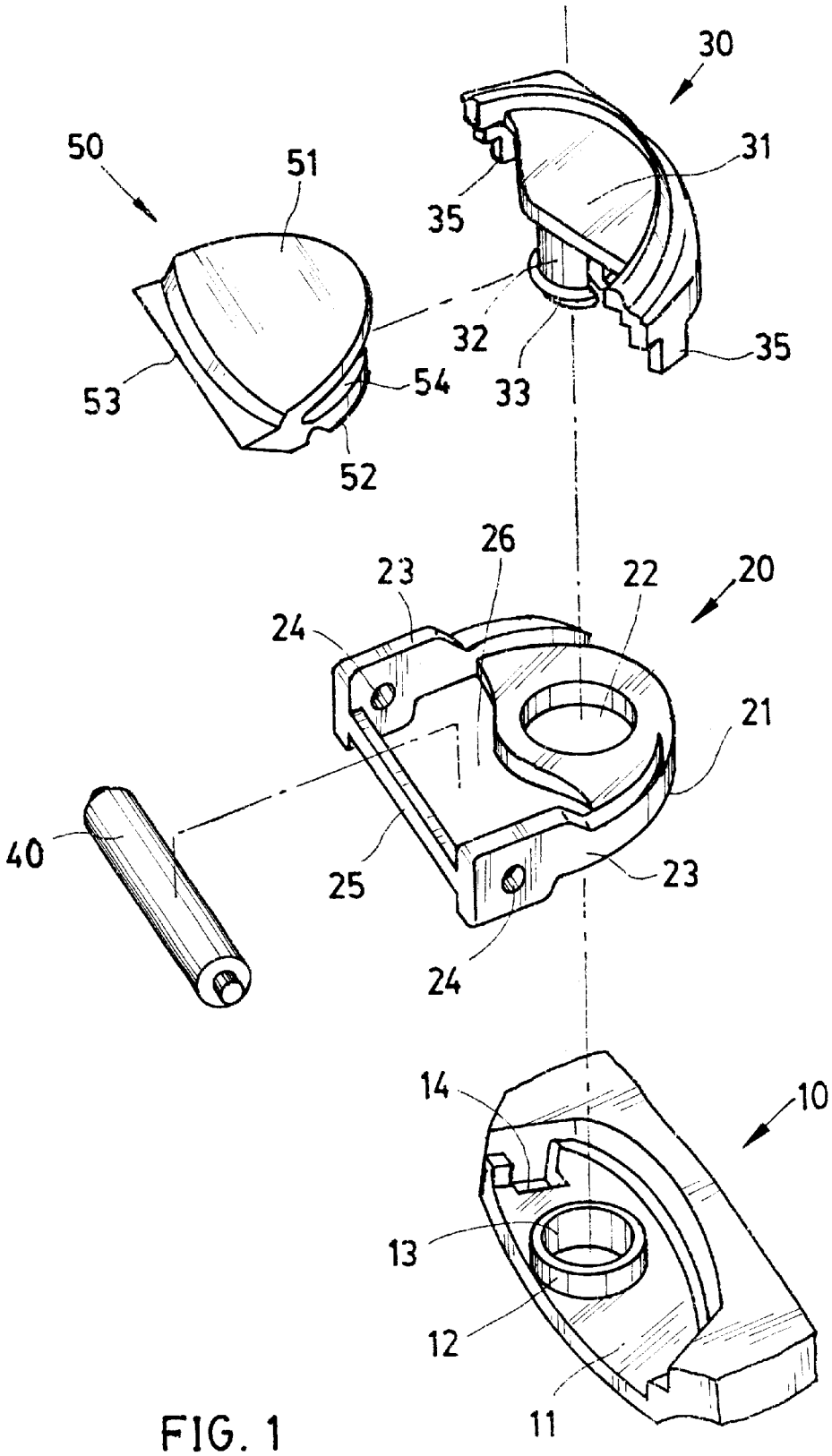
FIG. 1 is a exploded view of the present invention.
Figure 2:
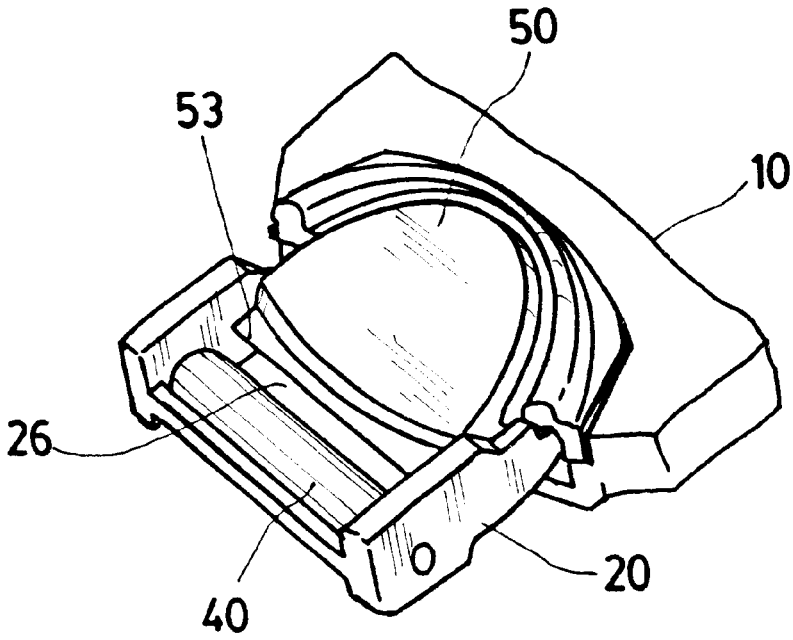
FIG. 2 is a isometric view of the present invention.

Referring to FIGS. 1 and 2, the buckel structure of the present invention mainly include the frame 10, a holder 20, a fixed cover 30, a roller 40, and a button 50.

The frame 10 presents the main structure of the two sides of the mask, which also includes the two sides of the frame where the mask glass goes and the soft mask goes. A flat board 11 is located on the frame 10, also a protrudent rim 12 is located on the flat board 11. A setting hole 13 is located at the middle of the protrudent rim 12, and inserting holes 14 are located at the two sides of the flat board 11.

A flat board 21 is located on the holder 20, and a hole 22 is located on the flat board 21. The holder 20 contains frames 23 on the two sides, and each frame 23 has a hole 24 on their side. At each tail of the two frames 23, a fixed stick 25 is attached, and a space 26 is created between the flat board 21 and the fixed stick 25.

A flat board 31 is located above the fixed cover 30, and a cylinder rod 32 is located below the flat board 31 where this cylinder rod's size decrease towards inside. A ring 33 is surround by the cylinder rod 32, and the two sides of the outer part 34 of the flat board 31 each has a tenon 35 below.

A roller 40 is located at the holes 24 of the holder 20.

Figure 3:
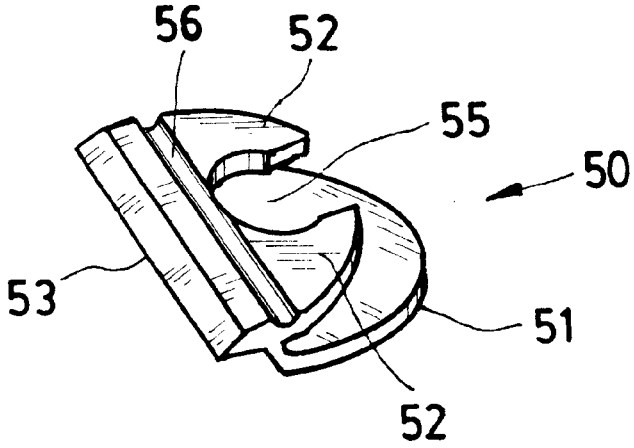
FIG. 3 is a opposite view of the button

Referring to FIGS. 1 and 3, the button 50 looks like a clip. The structure includes a pressing board 51, a fixed board 52, a stopper 53, an inserting opening 54 formed by the pressing board 51 and the fixed board 52, and finally a groove 56 below the fixed board 52. The stopper 53 has one side slanted.

Figure 4:
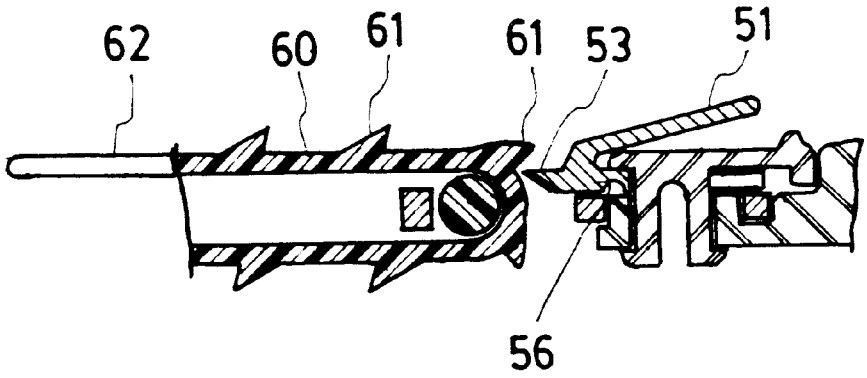
FIG. 4 is a sectional view (1) of the present invention.
Figure 5:
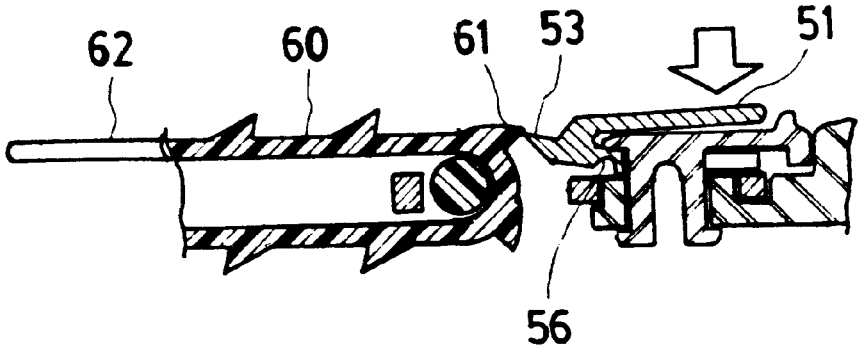
FIG. 5 is a sectional view (2) of the present invention.

Referring to FIGS. 1, 4 and 5, when the present invention is assembled, the roller 40 is located on the hole 24; the inserting opening 54 of the button 50 is clicked on the flat board 31; the tap opening 55 looks like an opening round hole has two slopping edge extending outwardly and is located on the cylinder rod 32, and the button 50 is located on fixed cover 30. The hole 22 of the holder 20 is located outside the protrudent rim 12, so that the cylinder rod 32 and ring 33 of the fixed cover 30 are allowed to go through the hole 22 and hole 13. The ring 33 is clicked below the hole 13, which at the same time, the tenon 35 is clocked into the inserting hole 14, just like what is shown on the FIG. 2. After these parts are assembled, the holder 20 can rotate within a small degree due to the protrudent rim 12. The fixed cover 30 is assembled with the frame 10. The fixed board 52 of the button 50 is clicked between the flat board 21 and the flat board 31, also they are limited between the holder 20 and the two side frame 23, where their motions are due to the holder 20. The strap 60 is located in the space 26 created by the roller 40 and the stopper 53.

Referring to FIGS. 4 and 5, the strap 60 is located between the roller 40 and the button 50. The strap 60 is made by soft and flexible material, where some teeth 61 are build on the strap 60. (Previous technology) One side of the teeth 61 is slanted; therefore, while pulling the strap 60, the teeth 61 are very easy to go through the area in front of the stopper 53. When the pulling force disappears, the strap 60 can turn back in the opposite direction, and the teeth 61 can easily stock sightly on the stopper 53.

If the user wants to losen the strap 60 described above, he/she just have to put force on the pressing board towards the direction of the arrow on FIG. 5. Since the fixed board 52 is clicked, button 50 would change its shape a little at the location of the groove 56, so the stopper 53 has its motion upward. At the same time, the soft flexible tooth 61 can go through the area in front of the stopper 53, so the strap 60 can be losen.

Due to the above descriptions, the present invention provided a very useful buckle structure, not only it can allow the strap 60 to rotate within a certain degree, it also can losen the strap 60 by pressing a board. Moreover, the present invention has components very easy to produce and assemble; therefore, the present invention can become a very useful buckle structure.

What is claimed is:

1. A buckle structure for a swimming mask comprising:

a) a frame having:

i) a flat frame surface;

ii) a setting hole with a protruding rim formed in the flat frame surface; and iii) two inserting holes located on opposite sides of the frame;

b) a holder having:

i) a flat holder surface including a through hole, the protruding rim of the frame being inserted into the through hole;

ii) two frames, each of the two frames connected at a first end thereof to a lateral side of the flat surface; and iii) a fixed bar connected at each of two opposing ends thereof to a second end of one of the two frames, the fixed bar being spaced apart from the flat holder surface;

c) a fixed cover having:

i) a flat cover surface including a cylindrical rod inserted through the setting hole in the frame; and ii) two tenons located on opposite sides of the fixed cover, each of the two tenons being inserted into one of the two inserting holes of the frame;

d) a roller rotatably connected at opposing ends thereof to the two frames of the holder and located between the flat surface and the fixed bar of the holder; and e) a button having:

i) a fixed board connected to the cylindrical rod of the fixed cover;

ii) a pressing board; and iii) a stopper connected to the pressing board, the pressing board and the stopper being movable between an engaged position and a disengaged position, such that in the engaged position the stopper is engaged with a tooth of a strap of the swimming mask thereby locking the strap in a fixed position between the roller and the stopper and in the disengaged position pressing board disengages the stopper from the tooth of the strap allowing the strap to move freely around the roller.

2. The buckle structure according to claim 1, further comprising a flexible groove located on a bottom of the button.

* * * * *